United States Patent [19]

Nomura

[11] Patent Number: 4,741,415

[45] Date of Patent: May 3, 1988

[54] CONTROL SYSTEM FOR AN AC ELEVATOR

[75] Inventor: Masami Nomura, Inazawa, Japan

[73] Assignee: Mitsubishi Denki Kabushiki Kaisha, Tokyo, Japan

[21] Appl. No.: 944,161

[22] Filed: Dec. 22, 1986

[30] Foreign Application Priority Data

Dec. 20, 1985 [JP] Japan ..... 60-287389
Jul. 10, 1986 [JP] Japan ..... 61-162414

[51] Int. Cl.[4] ..... B66B 1/32
[52] U.S. Cl. ..... 187/119; 318/762
[58] Field of Search ..... 187/119; 318/757, 760, 318/762

[56] References Cited

U.S. PATENT DOCUMENTS

| | | | |
|---|---|---|---|
| 4,042,069 | 8/1977 | Ohira et al. | 187/119 |
| 4,319,665 | 3/1982 | Komuro et al. | 187/119 |
| 4,491,197 | 1/1985 | Nishiwaki | 187/119 |
| 4,496,894 | 1/1985 | Petersen | 318/762 X |
| 4,545,464 | 10/1985 | Nomura | 187/119 |
| 4,567,555 | 1/1986 | Matsuse et al. | 318/762 X |

*Primary Examiner*—William M. Shoop, Jr.

*Assistant Examiner*—W. E. Duncanson, Jr.

*Attorney, Agent, or Firm*—Sughrue, Mion, Zinn, Macpeak and Seas

[57] ABSTRACT

Three pairs of reversed polarity thyristors *20a,21a; 24a,25a; 28c,29c* are connected directly between the three phases R, S, T of an AC power source and the corresponding phases of an elevator drive motor 5. The two pairs connected to the R and S phases implement upward driving, and the third pair connected to the T phase is used for both upward and downward driving but is held non-conductive during regenerative braking/deceleration when the motor operates in a two phase mode. Two additional thyristor pairs *22b,23b; 26b,27b* which are used for downward driving are cross-connected between the R and S power source phases and two of the motor phases, to thus reverse the direction of motor rotation. Different individual thyristors in the pairs coupled to the R and S phases are selected in upward and downward deceleration modes. The overall circuit arrangement and firing selection/-control scheme is designed to implement load sharing between the various thyristors and thus minimize duty cycle differences.

6 Claims, 5 Drawing Sheets

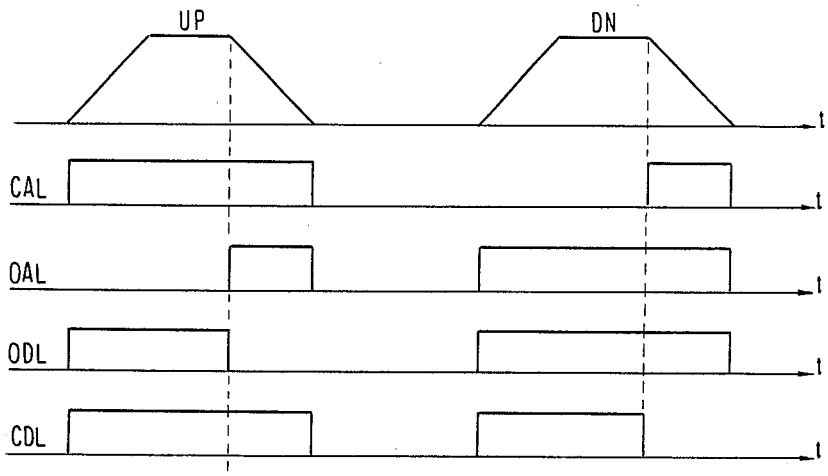
FIG.6
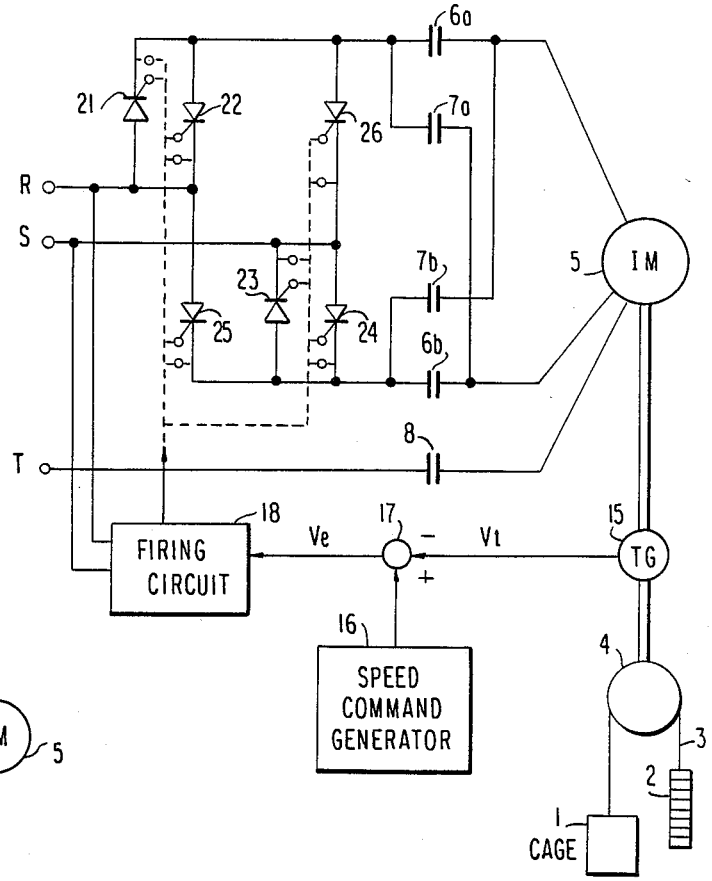
FIG.7
PRIOR ART
FIG.8a
PRIOR ART
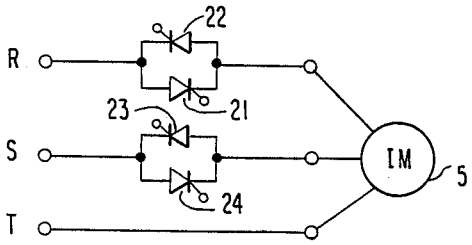
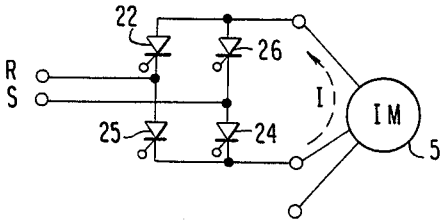
FIG.8b
PRIOR ART

CONTROL SYSTEM FOR AN AC ELEVATOR

BACKGROUND OF THE INVENTION

This invention relates to a control system for an AC elevator on the basis of thyristor control of a three-phase induction motor.

FIG. 7 shows a block diagram of a conventional AC elevator speed control system as disclosed in U.S. Pat. No. 4,491,197, including a cage 1, a counterweight 2, a main cable 3, a drive sheave 4, a three-phase induction motor 5, upward-drive electromagnetic contacts 6*a*, 6*b*, downward-drive electromagnetic contacts 7*a*, 7*b*, drive contacts 8, a tachometer generator 15, a speed command generator 16, an adder 17, a firing circuit 18, three-phase AC power source terminals R, S, T, a first pair of reversed polarity thyristors 21, 22 interposed between power source terminal R and contact 6*a*, a second pair of reversed polarity thyristors 23, 24 similarly interposed between power source terminal S and contact 6*b*, a third thyristor 25 connected between power source terminal R and contact 6*b*, and a fourth thyristor 26 connected between power source terminal S and contact 6*a*.

In operation, when upward driving is started contacts 6*a*, 6*b* and 8 are closed. The firing circuit 18 controls the firing angles or phases of the first and second pairs of thyristors 21–24 and does not fire the third and fourth thyristors 25, 26. This results in the circuit of FIG. 8*a*.

When the cage 1 arrives at a deceleration command point A (FIG. 9), contacts 8 are opened. When an error signal $V_e$ becomes negative, the firing circuit 18 stops controlling the firing phases of thyristors 21, 23 and instead controls the firing phases of thyristors 22 and 24–26. This results in the circuit of FIG. 8*b*. During deceleration, thyristors 24 and 26 in the circuit of FIG. 8*b* are always rendered conductive, during both upward and downward driving, as it is desirable for the flywheel current flowing through motor 5 to also flow through thyristors 24 and 26. That is, when all of the thyristors 22 and 24–26 are controlled with reference to their firing phases, a current $I_1$ flows intermittently through motor 5 as shown in FIG. 8*c*, while the flywheel current is a more continuous current $I_2$ with less ripples. As a result, fluctuations in the torque of the motor 5 are reduced, a more comfortable cage ride is provided, and the noise produced by the motor is reduced.

It should be noted that the first and second pairs of thyristors 21, 22 and 23, 24 may be bidirectional thyristors.

FIG. 9 shows the currents which the respective thyristors carry during acceleration and deceleration. As will be obvious from this Figure, the current share greatly varies from one thyristor to another. Thus, if thyristors having the same rating as thyristors 24 and 26 are used, the other thyristors will have an excessive thermal capacity and be unduly costly. If the ratings of the thyristors are determined individually in accordance with their current shares, however, the number of components would increase and fabrication would be undesirably inefficient. In FIG. 9 the slanted lines show the full firing periods of the thyristors being controlled, the uppermost indication is a speed curve, and the remaining indications show the current intervals shared by the other thyristors.

With such a conventional control system some of the thyristors are used for both power running and DC damping force generation, and as a result the currents shared by the individual thyristors are not equal and the ratings of the thyristors cannot be selected from an economical standpoint. In this system the interposed thyristors are used for only two phases of the motor, and when the phases of the thyristors are controlled when the cage is started, unbalanced currents flow through the motor and motor noise increases as well as energy consumption. In addition, upon the generation of a deceleration command the mechanical contacts 8 are opened to switch the motor to single-phase power running, and delayed contact operation occurs. This results in an uncomfortable cage ride.

SUMMARY OF THE INVENTION

This invention has been made to solve the above problems. It is an object of this invention to provide a control system for an AC elevator which can average or more evenly distribute the currents shared by the individual thyristors, which eliminates mechanical contacts, and which provides a more stable operation.

A control system for an AC elevator according to this invention includes a pair of upward drive reversed polarity thyristors and a pair of downward drive reversed polarity thyristors connected in at least two corresponding phases of a three-phase induction motor which drives the elevator cage upwardly and downwardly. During the deceleration of the motor, part of both the upward drive and the downward drive thyristors are controllably fired to apply DC damping to the motor.

During upward driving, the firing angles of two pairs of drive thyristors are controlled to provide power-running torque to move the cage upwardly. During downward driving, the firing angles of the two other pairs of thyristors are controlled to move the cage downwardly. During upward deceleration and damping, part of the thyristors used when the upward movement is started and part of the thyristors used in the downward driving are used to DC-damp the motor. During downward deceleration and damping, the thyristors not used in the above operations are used to DC-damp the motor.

A control system for an AC elevator according to this invention includes a firing circuit which controls the firing of the individual thyristors for driving the cage upwardly and downwardly in order to lift and lower the cage, and which fully or partially fires the thyristors such that they constitute a single-phase hybrid bridge rectifier circuit for the motor during upward or downward deceleration. During deceleration driving, the rectifier circuit forms a DC damping circuit which controls the firing of part of the thyristors in accordance with the direction of deceleration, and which fully fires part of the other thyristors to effectively change them to flywheeling diodes. A more even balance or conduction load distribution between the various thyristor currents is thus obtained.

BRIEF DESCRIPTION OF THE DRAWINGS

FIG. 6 illustrates the operation of the thyristors subjected to phase control;

FIG. 7 is a schematic/block diagram of a conventional control system for an AC elevator;

FIGS. 8*a* and 8*b* illustrates the operation of the system of FIG. 7;

DETAILED DESCRIPTION OF THE PREFERRED EMBODIMENT

Figure 1:
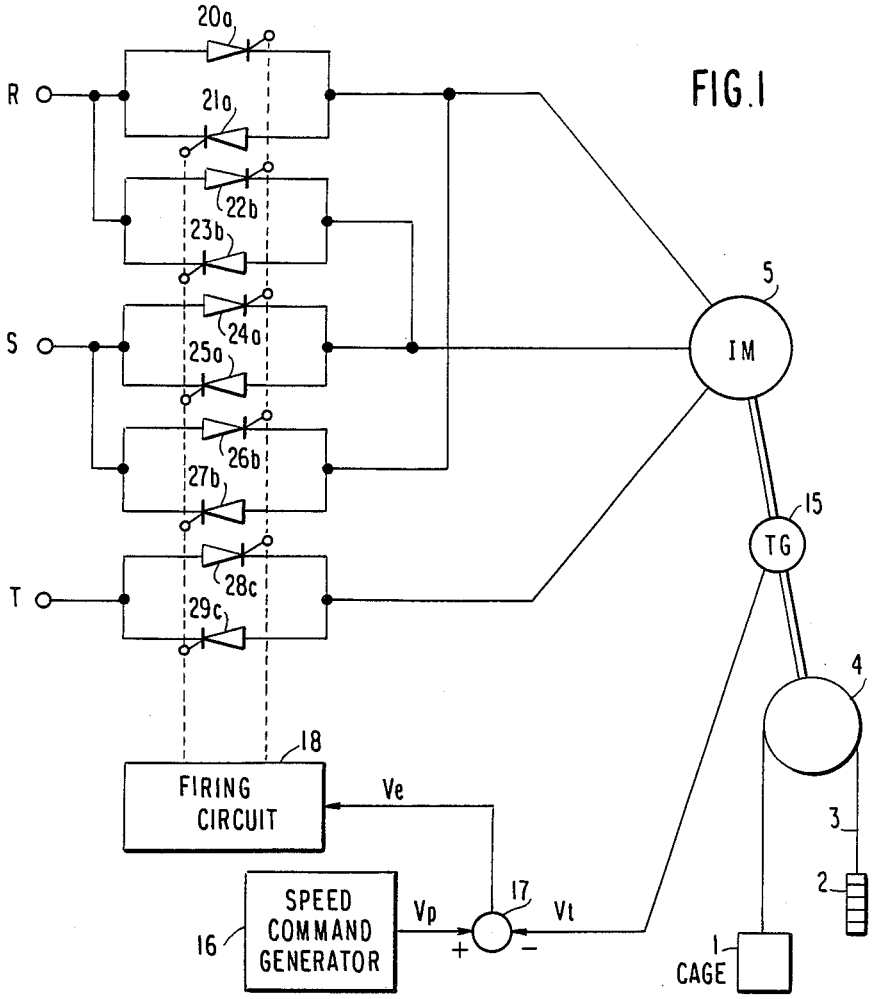
FIG. 1 is a schematic/block diagram showing a control system for an AC elevator according to one embodiment of this invention.

In FIG. 1 reference numerals 1–5 and 15–18 denote the same parts as in the conventional device. Reference numerals 20*a*, 21*a*, 24*a* and 25*a* denote a group of thyristors which constitute the upward drive reversed polarity pairs, reference numerals 22*b*, 23*b*, 26*b* and 27*b* denote a group of thyristors which constitute the downward drive reversed polarity pairs, and reference numerals 28*c* and 29*c* denote a pair of reversed polarity thyristors used for switching between three-phase and single-phase operation.

In operation, when the cage 1 is to be accelerated upwardly by the three-phase induction motor 5, the firing circuit 18 controls the firing angles of the upward drive thyristors 20*a* 21*a*, 24*a*, 25*a* and the three-phase/-single-phase switching thyristors 28*c*, 29*c* to operate the motor in a three-phase mode to start the cage. When the cage is to be accelerated downwardly the firing circuit 18 also controls the firing of the three-phase/single-phase thyristors 28*c*, 29*c* to implement three-phase operation of the motor, and selects the downward drive thyristors 22*b*, 23*b*, 26*b*, 27*b* instead of the upward drive thyristors and controls their firing angles to switch the direction of phase rotation of the motor.

Figure 2A:
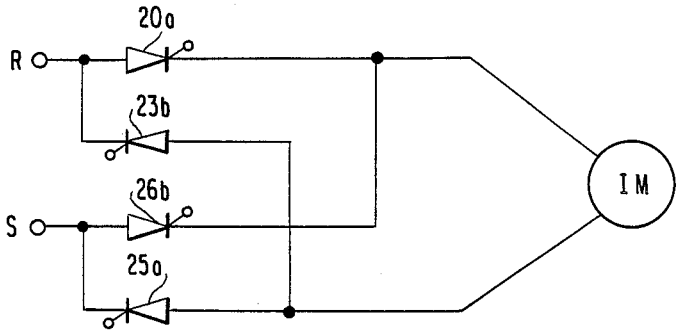
FIGS. 2*a* and 2*b* illustrate the operation of the system of FIG. 1.

When the cage 1 is decelerated upwardly, the firing angles of the upward and downward drive thyristors 20*a*, 23*b*, 25*a*, 26*b* are controlled to form the circuit shown in FIG. 2*a*, to thereby control the direct current flowing through the motor 5 to implement DC damping to decelerate the cage.

Figure 2B:
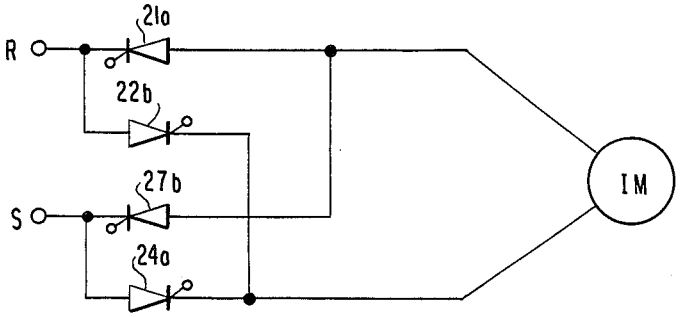

When the cage is decelerated downwardly, the firing angles of the upward and downward drive thyristors 21*a*, 22*b*, 24*a* and 27*b* are similarly controlled to form the circuit shown in FIG. 2*b*, to thereby control the direct current flowing through the motor in a manner or direction opposite to that when the cage is decelerated upwardly, in order to implement DC damping to decelerate the cage.

Figure 3:
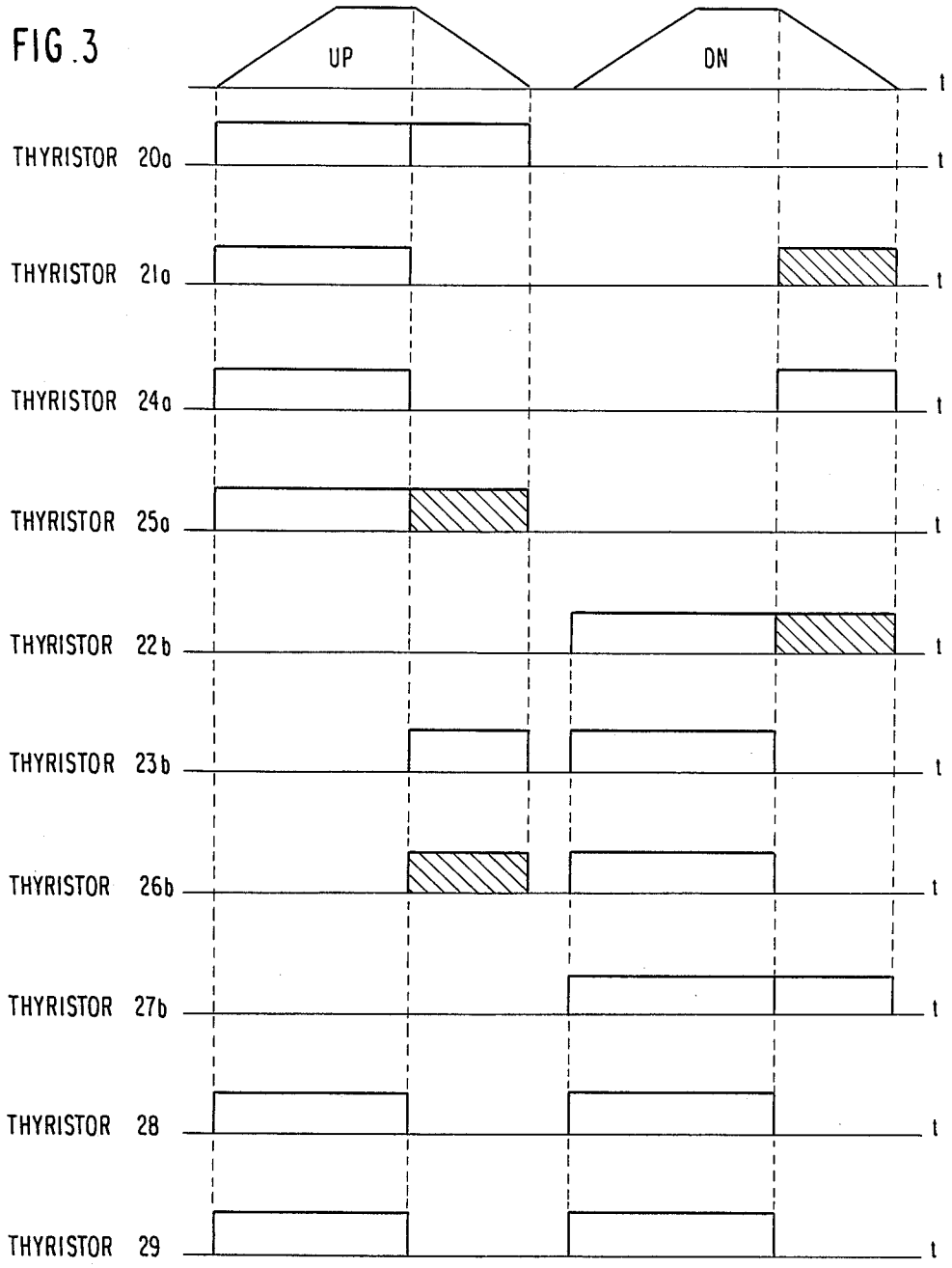
FIG. 3 is a sequence diagram explaining the operation of the respective thyristors in FIG. 1.
Figure 3A:
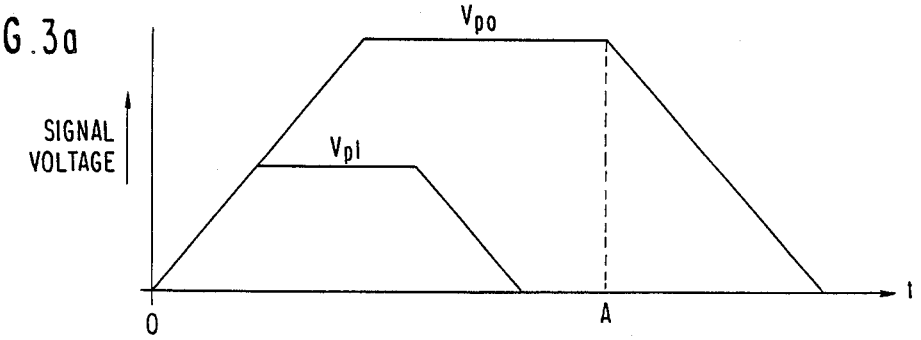
FIG. 3*a* is a diagram showing the driving characteristic of an elevator.

FIG. 3*a* shows speed command signals. Curve $V_{po}$ denotes a speed signal used for moving the cage at a rated speed determined by the number of poles of the motor and the frequency of the power source. Curve $V_{p1}$ denotes a speed command signal used for moving the cage at a speed less than the rated speed when the distance from the start floor to a stop floor is short.

When a speed command signal such as $V_{po}$ accelerates the motor up to its rated speed, it is excited by the three-phase AC until it arrives at a deceleration starting point. Even when the motor produces a damping force as in a no-load upward drive and a full-load downward drive, the thyristors are fully fired to allow the mechanical energy to return to the power source. After point A, the thyristors which are controlled by the positive and negative error signal $V_e$ between the speed command signal $V_p$ and the sensed speed signal $V_t$ are selected to perform a power running or a DC damping operation on the motor.

On the other hand, as in the case of $V_{p1}$ when the motor is not accelerated up to its rated speed, the thyristors which are controlled in accordance with the positive and negative error signal between $V_p$ and $V_t$ are selected even at constant driving, and the motor torque is controlled between power driving and damping to drive the cage.

When the motor is operated in an upward deceleration mode, the firing phases of thyristors 26*b*, 25*a* in FIG. 2*a* are not controlled according to the speed feedback error signal, but instead they are fully fired throughout half of each period at the AC source terminals R and S to thus be maintained in the conductive state. With the motor flywheel current thus flowing through the thyristors 26*b*, 25*a* during upward deceleration, the motor current will be smoothed, a more comfortable ride in the elevator will be provided, and at the same time the motor noise will be reduced.

During downward deceleration the thyristors 21*a*, 22*b* of FIG. 2*b* are similarly fully fired to be held continuously conductive, with the same beneficial results.

The thyristors 20*a*, 23*b*, 26*b*, 25*a* which constitute the damping circuit used in the upward deceleration mode are thus different from the thyristors 21*a*, 22*b*, 27*b*, 24*a* which constitute the damping circuit used in the downward deceleration mode. In addition, the thyristors 26*b*, 25*a* which are connected to the S phase terminal are selected to conduct the flywheel current during the upward deceleration mode, and the thyristors 21*a*, 22*b* which are connected to the R phase terminal are selected during the downward deceleration mode to conduct the flywheel current. This more even load sharing or distribution significantly equalizes the thermal balance between the thyristors, as may be seen from FIG. 3.

Especially recently, thyristor packages each containing a pair of reversed polarity thyristors are being manufactured. If these thyristor packages are used as shown in the foregoing embodiment, the thermal balance for each package (also referred to as a thyristor module) is improved advantageously.

Figure 4:
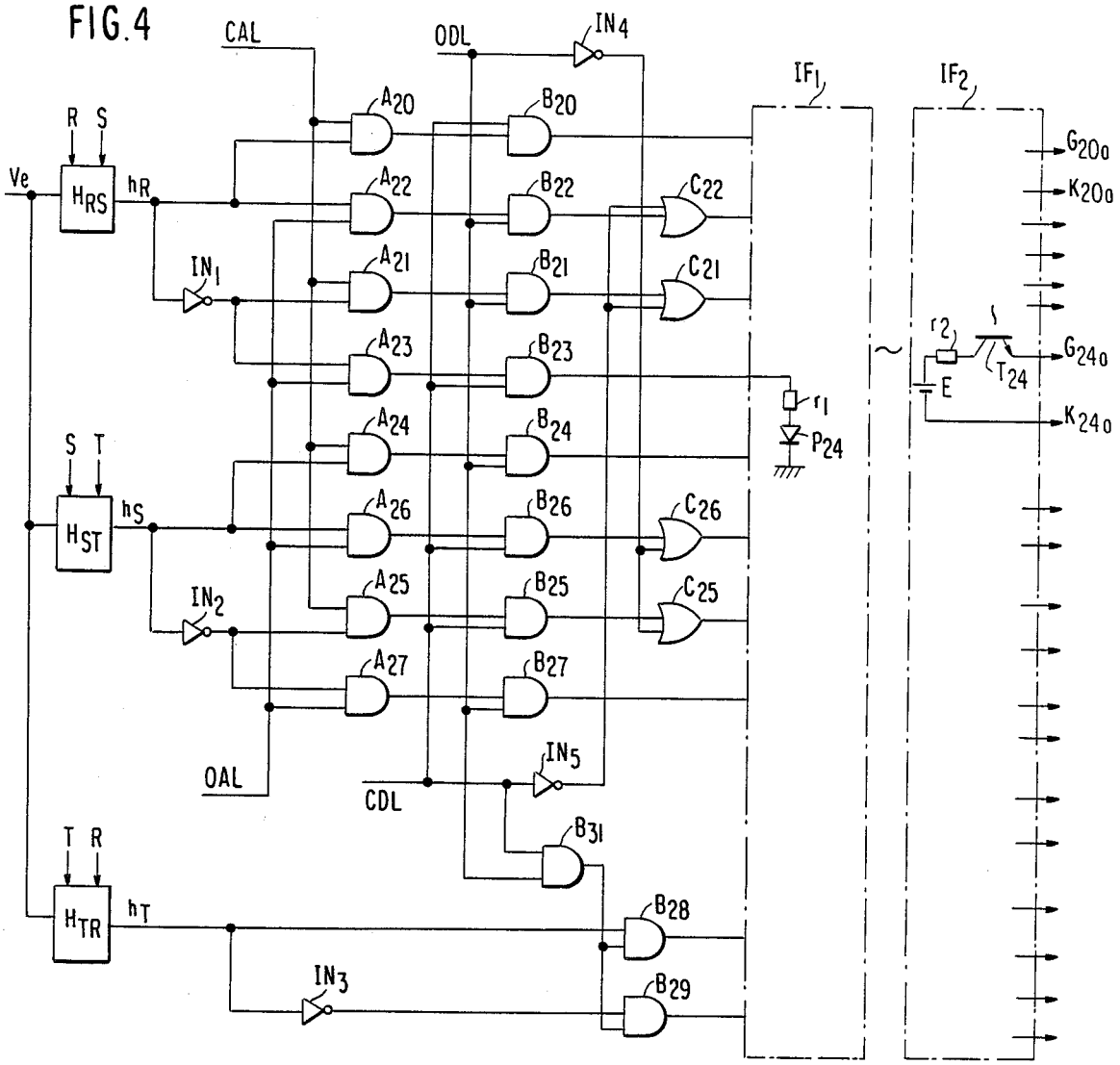
FIG. 4 illustrates the firing circuit of FIG. 1 in greater detail.
Figure 5:
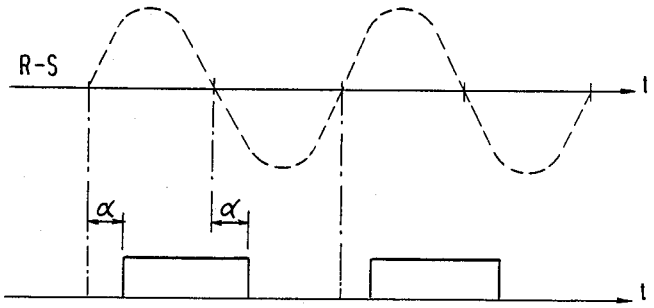
FIG. 5 illustrates the phase control by the firing circuit.
Figure 8C:
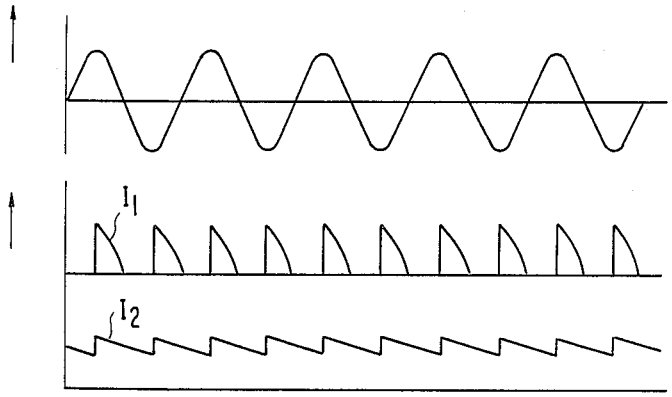
FIG.8c PRIOR ART
FIG. 8*c* shows various current waveforms for the induction motor of the FIG. 7 system during deceleration.
Figure 9:
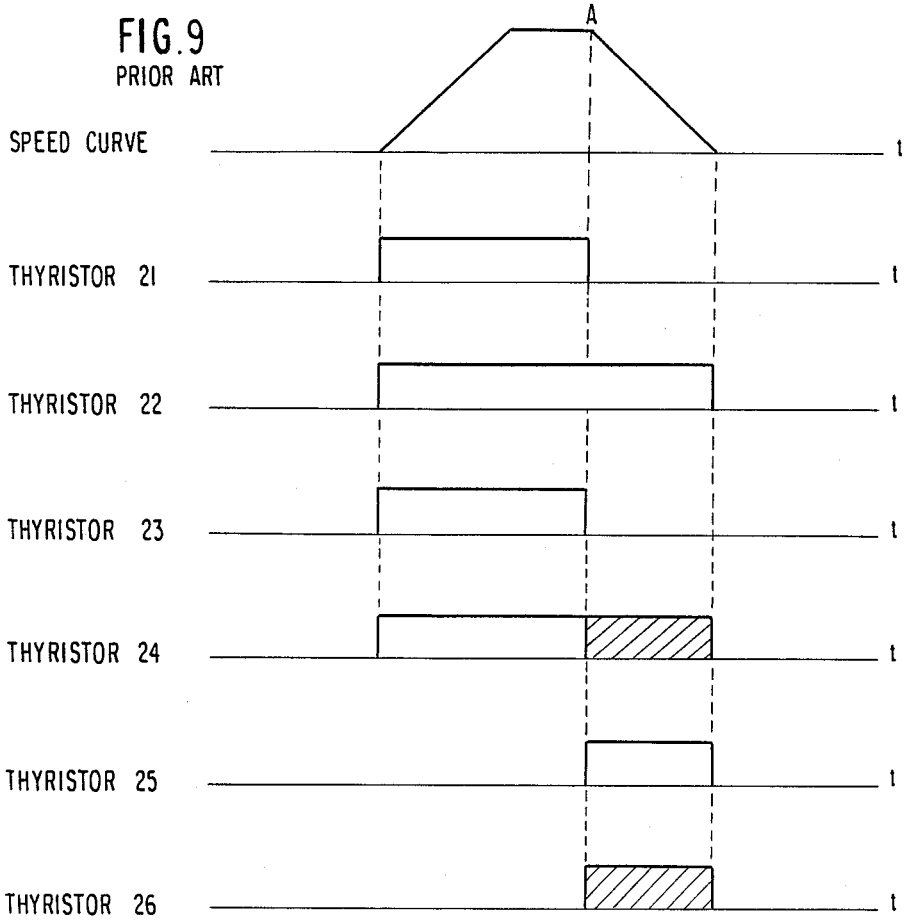
FIG.9 PRIOR ART
FIG. 9 is a sequence diagram explaining the operation of the respective thyristors of FIG. 7.

FIG. 4 shows an example of the inside of the firing circuit 18, wherein reference characters $H_{RS}$, $H_{ST}$ and $H_{TR}$ each denote a phase control circuit to change the firing phases of the thyristors in accordance with an input error signal. The outputs of these phase control circuits are $h_R$, $h_S$, $h_T$; FIG. 5 shows a typical example of $h_R$. The output pulses $h_S$, $h_T$ are delayed by a control angle relative to the phases of the phase voltages, S-T, T-R, relatively. Reference characters $A_{20}$–$A_{27}$ and $B_{20}$–$B_{27}$ denote AND gates; $C_{22}$, $C_{21}$, $C_{26}$ and $C_{25}$ are OR gates; reference characters $IN_1$–$IN_5$ are inverters.

Reference characters $IF_1$, $IF_2$ denote interface circuits enclosed by dot-dash lines and which are electrically isolated from each other; signals are transmitted between them by photo couplers. The circuits $IF_1$ and $IF_2$ have the same interior structure with reference to their input and output signals. As a typical example in the operation of the circuits $IF_1$, $IF_2$, when $B_{23}$ becomes high, the diode $P_{24}$ of the photo coupler emits light to render conductive a transistor $T_{24}$ of the $IF_2$ circuit. This causes an input signal to be applied to the gate $G_{24a}$ of thyristor 24a from power source E, thereby firing the thyristor. Characters $r_1$, $r_2$ denote limiting resistors.

Control signals CAL, OAL, ODL and CDL are produced as shown in FIG. 6 by a pattern generator (not shown) in accordance with the commanded upward and downward operational modes. These signals, inputted as shown in FIG. 4, control the thyristor firings in the sequences shown in FIG. 3, wherein the cross-hatched portions indicate that thyristors 21a, 22b or 25a, 26b are rendered continuously conductive even when the signal CDL or ODL is low. That is, during speed reduction control, when the signal CDL or ODL is low, it is inverted and inputted as high to its associated OR gates. The OR gates $C_{22}$, $C_{21}$ or $C_{25}$, $C_{26}$ thus produce high outputs at all such times, so that thyristors 21a, 22b, or 25a, 26b are rendered continuously conductive. These thyristor pairs connected to the S or R phase terminals of the full-wave rectifier circuits of FIGS. 2a, 2b thus act like diodes to form a quasi-bridge circuit and thereby smooth the motor current waveform.

The reason why the thyristors held continuously conductive are different for the upward and downward driving operations is to more effectively average their overall duty cycles and to thus prevent the excessive use of only particular thyristors and avoid an unbalanced rise in temperature.

As described above, according to this invention upward and downward driving reversed polarity thyristors included in the control system are selectively controlled during elevator deceleration. The thyristors connected to a first phase of the AC source are rendered conductive throughout upward deceleration, and the thyristors connected to a second source phase are conductive throughout downward deceleration. Thus, all of the thyristors are used in a well balanced manner and the overall device is both small and may be economically manufactured.

What is claimed is:

1. A control system for an elevator driven by a three-phase induction motor (5), comprising:

(a) an upward driving thyristor circuit including first and second reversed polarity thyristor pairs (20a, 21a; 24a, 25a) individually connected between first and second phase terminals (R, S) of a three-phase AC power source and said motor;

(b) a downward driving thyristor circuit including third and fourth reversed polarity thyristor pairs (22b, 23b, 26b, 27b) individually connected between said first and said second phase terminals of said power source and said motor, said downward driving thyristor circuit pairs being disposed in parallel with respective upward driving thyristor circuit pairs;

(c) a three-phase/single-phase switching thyristor circuit connected between a third phase terminal (T) of said power source and said motor, and including a fifth pair of reversed polarity thyristors (28c, 29c); and (d) firing circuit means (18) for selectively and sequentially controlling the conduction of all of said thyristors in a predetermined pattern and based on a difference signal between actual and commanded speed signals in such a manner as to substantially equalize the overall duty cycles of the individual thyristors for all operational modes, (e) wherein, when said motor is subjected to DC damping, the conduction of a thyristor selected in said upward driving thyristor circuit and the conduction of a thyristor selected in said downward driving thyristor circuit is controlled, and wherein said thyristors (25a, 26b) selected during DC damping in an upward direction are different from said thyristors (21a, 22b) selected during DC damping in a downward direction.

2. A control system according to claim 1, wherein when said motor is driven in a power running mode, the conduction of one of said upward and downward driving thyristor circuits and the conduction of said three-phase/single-phase switching thyristor circuit are controlled.

3. A control system according to claim 1, wherein when DC damping is performed during upward driving, the conduction of a first thyristor (20a) selected in one of said upward drive thyristor pairs and the conduction of a second thyristor (23b) selected in one of said downward driving thyristor pairs and opposite in polarity to said selected first thyristor are controlled in a manner related to each other; and the conduction of a first thyristor (26b) selected in the other of said downward drive thyristor pairs and having the same polarity as the first thyristor selected in said one of said upward driving thyristor pairs and the conduction of a second thyristor (25a) selected in the other of said upward driving thyristor pairs and having the same polarity as said second thyristor selected in said one of said downward driving thyristor pairs are controlled in a manner related to each other.

4. A control system according to claim 3, wherein when direct current damping is performed during downward driving, the conduction of a second thyristor (21a) selected in said one of said upward driving thyristor pairs and the conduction of a first thyristor (22b) selected in said one of said downward driving thyristor pairs are controlled in a manner related to each other; and the conduction of a second thyristor (27b) selected in said other of said downward driving thyristor pairs and the conduction of a first thyristor (24a) selected in said other of said upward driving thyristor pairs are controlled in a manner related to each other.

5. A control system according to claim 1, wherein when said motor is driven in a power running mode, the conduction of said fifth pair of thyristors of said three-phase/single-phase switching thyristor circuit are controlled; and wherein when said motor is subjected to DC damping, said fifth pair of thyristors are maintained non-conductive.

6. A control system for an elevator, comprising:

(a) a three-phase induction motor (5) for driving a cage, (b) a three-phase AC power source, (c) three pairs of cage upward driving reversed polarity thyristors individually connected between each phase of said power source and respective phases of said motor, (d) a first pair of cage downward driving reversed polarity thyristors (22b, 23b) connected between a first phase (R) of said power source and a second phase of said motor, (e) a second pair of cage downward driving reversed polarity thyristors (26b, 27b) connected between a second phase (S) of said power source and a first phase of said motor, and (f) firing circuit means (18) for:

(1) controlling the firing angles of predetermined ones of said thyristor pairs during upward and downward driving of said cage, (2) controlling the firing angles of first predetermined thyristors (20*a*, 23*b*) connected to said first power source phase and fully firing second predetermined thyristors (25*a*, 26*b*) connected to said second power source phase during upward deceleration of said cage to implement DC damping, and (3) fully firing third predetermined thyristors (21*a*, 22*b*) connected to said first power source phase and controlling the firing angles of fourth predetermined thyristors (24*a*, 27*b*) connected to said second power source phase during downward deceleration of said cage, said first, second, third and fourth predetermined thyristors all being different to thereby substantially equalize the duty cycles of the various thyristors, and the firing circuit being responsive to a difference signal between actual and commanded speed signals.

* * * * *